US005376031A

United States Patent [19]

Meisenburg et al.

[11] Patent Number: 5,376,031

[45] Date of Patent: Dec. 27, 1994

[54] MARINE DRIVE WITH SURFACING TORPEDO

[75] Inventors: Gary L. Meisenburg; Phillip D. Magee; John W. Behara, all of Stillwater, Okla.

[73] Assignee: Brunswick Corporation, Lake Forest, Ill.

[21] Appl. No.: 83,280

[22] Filed: Jun. 25, 1993

Related U.S. Application Data

[63] Continuation-in-part of Ser. No. 889,495, May 27, 1992, Pat. No. 5,230,644, and a continuation-in-part of Ser. No. 889,530, May 27, 1992, Pat. No. 5,249,995.

[51] Int. Cl.[5] ..... B63H 21/24

[52] U.S. Cl. ..... 440/76; 440/81; 440/78

[58] Field of Search ..... 440/61, 75–83, 440/900; 123/195 P

[56] References Cited

U.S. PATENT DOCUMENTS

| | | | |
|---|---|---|---|
| 2,386,362 | 10/1945 | Soldner | 440/75 |
| 2,528,628 | 11/1950 | Whitney | 440/78 |
| 3,952,686 | 4/1976 | Pichl | 115/7 |
| 4,630,719 | 12/1986 | McCormick | 192/21 |
| 4,679,682 | 7/1987 | Gray, Jr. et al. | 192/21 |
| 4,764,135 | 8/1988 | McCormick | 440/83 |
| 4,790,782 | 12/1988 | McCormick | 440/61 |
| 4,792,315 | 12/1988 | Karrasch et al. | 440/83 |
| 4,795,382 | 1/1989 | McCormick et al. | 440/81 |
| 4,832,635 | 5/1989 | McCormick | 440/78 |
| 4,832,636 | 5/1989 | McCormick | 440/80 |
| 4,863,406 | 9/1989 | Bland et al. | 440/83 |
| 4,869,121 | 9/1989 | Meisenburg | 440/80 |
| 4,869,694 | 9/1989 | McCormick | 440/83 |
| 4,871,334 | 10/1989 | McCormick | 440/80 |
| 4,897,058 | 1/1990 | McCormick | 440/78 |
| 4,898,553 | 2/1990 | Bankstahl | 440/78 |
| 4,900,281 | 2/1990 | McCormick | 440/78 |
| 4,993,848 | 2/1991 | John et al. | 440/78 |

*Primary Examiner*—Edwin L. Swinehart

*Attorney, Agent, or Firm*—Andrus, Sceales, Starke & Sawall

[57] ABSTRACT

A marine drive (10) has two counter-rotating surface operating propellers (12 and 14). The lower horizontal torpedo portion (188) of the housing (20) has an upper zone (276) with outer surface profiles (11T–17T) along horizontal cross-sections defining wedges with sharp leading tips (11LT–17LT) forming a sharp leading edge (278) for slicing through the water, the sharp leading tips (11LT–17LT) defining the sharp leading edge (278) defining a first line extending downwardly and rearwardly at a first angle (280) relative to vertical. The torpedo portion (188) has a lower zone (270) with outer surface profiles (1B–10B) along horizontal cross-sections defining wedges with sharp leading tips (1LT–10LT) defining a second line (272) extending downwardly and rearwardly at a second angle (274) relative to vertical. The housing (20) includes a skeg (194) extending downwardly from the lower zone (270) of the torpedo portion (188), the skeg having a leading edge (288) defining a third line extending downwardly and rearwardly at a third angle (290) relative to vertical. The third angle (290) is greater than the first angle (280) and less than the second angle (274). The first, second and third lines (278, 272, 288) all intersect at the same point (284) which point is on the rotational axis (286) of the concentric counter-rotating propeller shafts (156, 158).

12 Claims, 6 Drawing Sheets

MARINE DRIVE WITH SURFACING TORPEDO

CROSS REFERENCE TO RELATED APPLICATIONS

This application is a continuation-in-part of allowed U.S. application Ser. No. 07/889,495, filed May 27, 1992, now U.S. Pat. No. 5,230,644 and allowed U.S. application Ser. No. 07/889,530, filed May 27, 1992, now U.S. Pat. No. 5,249,995 incorporated herein by reference.

BACKGROUND AND SUMMARY

The invention relates to a marine drive having two counter-rotating surface operating propellers.

The invention arose during development efforts directed toward a marine drive enabling increased top end boat speed. Surfacing drives for eliminating torpedo drag are known in the art, for example U.S. Pat. No. 4,871,334, column 3, lines 35+.

In one aspect of the present invention, the drive housing is provided with a low drag specially contoured surfacing torpedo.

In another aspect, the torpedo portion of the housing has outer surface profiles along horizontal cross-sections defining wedges with sharp leading tips forming a sharp leading edge for slicing through the water at the surface.

In another aspect, the torpedo portion has an upper zone with outer surface profiles along horizontal cross-sections defining wedges with sharp leading tips forming a sharp leading edge for slicing through the water, the sharp leading tips forming a sharp leading edge defining a first line extending downwardly and rearwardly at a given angle relative to vertical. The torpedo portion has a lower zone with outer surface profiles along horizontal cross-sections defining wedges with leading tips defining a second line extending downwardly and rearwardly at a second angle relative to vertical, the second angle being greater than the first angle.

In another aspect, the housing includes a skeg extending downwardly from the lower zone of the torpedo portion, the skeg having a leading edge defining a third line extending downwardly and rearwardly at a third angle relative to vertical, the third angle being greater than the first angle and less than the second angle.

DETAILED DESCRIPTION

Figure 1:
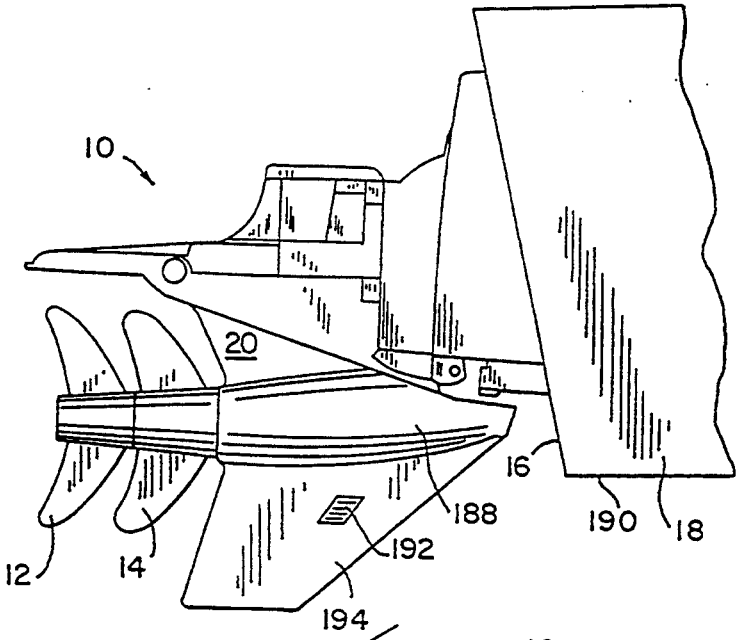
FIG. 1 is a side elevation view of a marine drive in accordance with the invention.

FIG. 1 shows a marine drive 10 having two counter-rotating surface operating propellers 12 and 14. The drive is mounted to the transom 16 of a boat 18 in the usual manner for a stern drive. The drive includes a housing 20, FIG. 2, having upper and lower spaced horizontal bores 22 and 24, and an intersecting vertical bore 26 extending therebetween. An upper input shaft 28 is in upper horizontal bore 22 and is coupled through a universal joint 30 to an input shaft 32 driven by the engine (not shown) in the boat. The universal joint enables trimming and steering of the drive. The input shaft drives an upper gear assembly 34 which is known in the art, for example as shown in U.S. Pat. No. 4,630,719, 4,679,682, and 4,869,121, incorporated herein by reference. A downwardly extending driveshaft 36 in vertical bore 26 is driven by input shaft 28 through upper gear assembly 34 operatively connected therebetween. Input gear 38 on shaft 28 rotates about a horizontal axis and drives gears 40 and 42 to rotate in opposite directions about a vertical axis. Shift and clutch assembly 44 causes engagement of one or the other of gears 40 and 42, to in turn cause rotation of driveshaft 36 in one or the other direction, to provide forward or reverse operation, all as in the noted incorporated patents.

Figure 3:
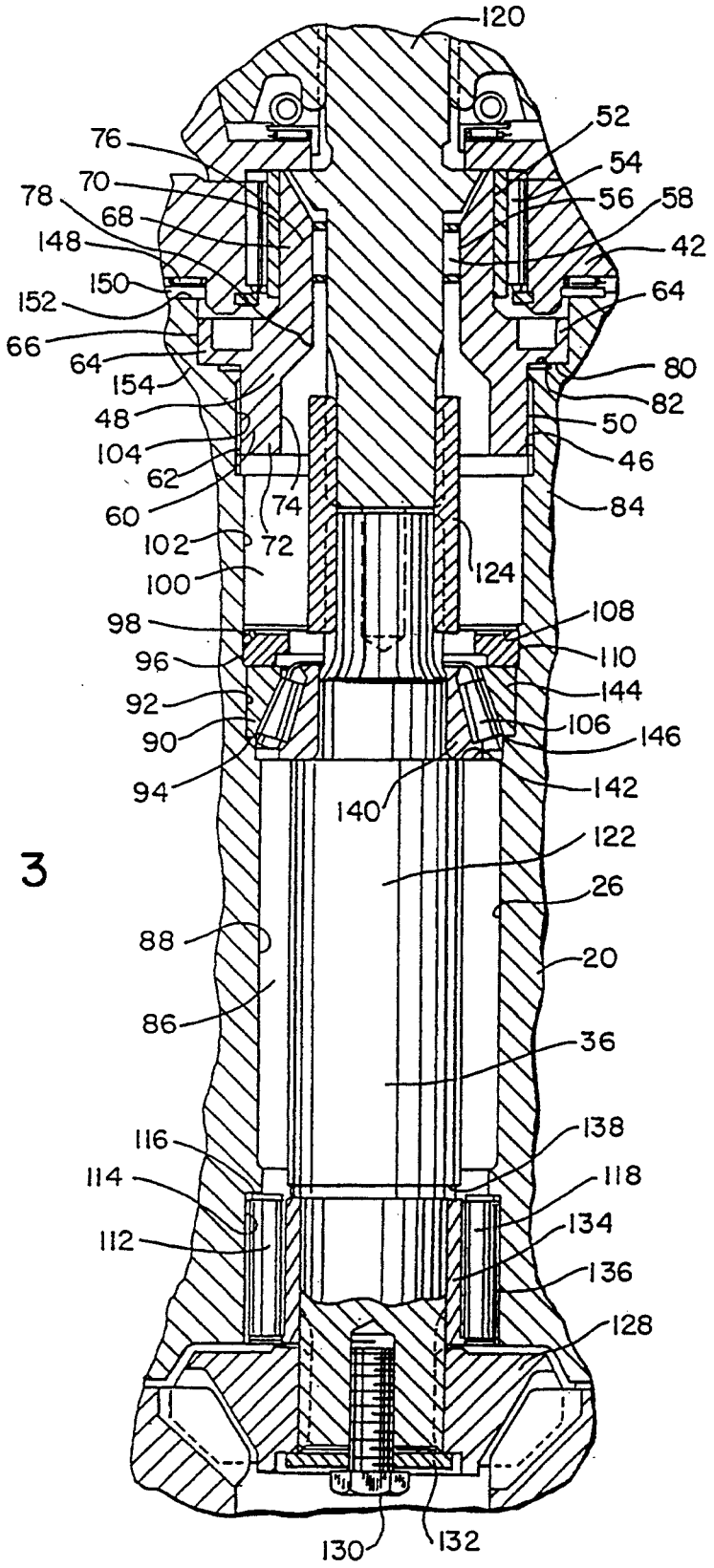
FIG. 3 is an enlarged view of a portion of the structure of FIG. 2.

Vertical bore 26 has an upper threaded portion 46, FIG. 3. An upper adaptor spool 48 has a lower threaded outer portion 50 mating with threaded portion 46 of vertical bore 26 and supporting gear 42 for rotation about driveshaft 36. Adaptor spool 48 has an upper outer surface 52 supporting an upper outer needle bearing 54 which supports gear 42 for rotation about adaptor spool 48. Adaptor spool 48 has an upper inner surface 56 supporting an upper inner needle bearing 58 which supports driveshaft 36 for rotation in adaptor spool 48.

Adaptor spool 48 has a lower outer section 60, FIG. 3, of a first outer diameter 62 and threaded as noted at 50 and mating with upper threaded portion 46 of vertical bore 26. Adaptor spool 48 has a central outer section 64 above lower outer section 60 and of a central outer diameter 66 larger than lower outer diameter 62. Adaptor spool 48 has an upper outer section 68 above central outer section 64 and of an upper outer diameter 70 less than central outer diameter 66 and less than lower outer diameter 62. Adaptor spool 48 has a lower inner section 72 of a lower inner diameter 74 within vertical bore 26. Adaptor spool 48 has an upper inner section 76 above lower inner section 72 and of an upper inner diameter 78 less than lower inner diameter 74. Upper outer needle bearing 54 is between gear 42 and upper outer section 68 of adaptor spool 48 and supports gear 42 for rotation about adaptor spool 48. Upper inner needle bearing 58 is between driveshaft 36 and upper inner section 76 of adaptor spool 48 and supports driveshaft 36 for rotation in adaptor spool 48. Lower outer section 60 and central outer section 64 of adaptor spool 48 meet at a downwardly facing annular shoulder 80 at the top end 82 of housing sidewall 84 forming vertical bore 26. Upper outer diameter 70 is substantially equal to lower inner diameter 74 of adaptor spool 48.

Vertical bore 26 has a first section 86, FIG. 3, of a first inner diameter 88. Vertical bore 26 has a second section 90 above first section 86 and of a second inner diameter 92 larger than inner diameter 88. Sections 86 and 90 meet at an upwardly facing annular shoulder 94. Vertical bore 26 has a first thread 96 above second section 90 and of an inner diameter 98 at least as great as second inner diameter 92. Vertical bore 26 has a third section 100 above first thread 96 and of a third inner diameter 102 greater than second inner diameter 98.

Figure 4:
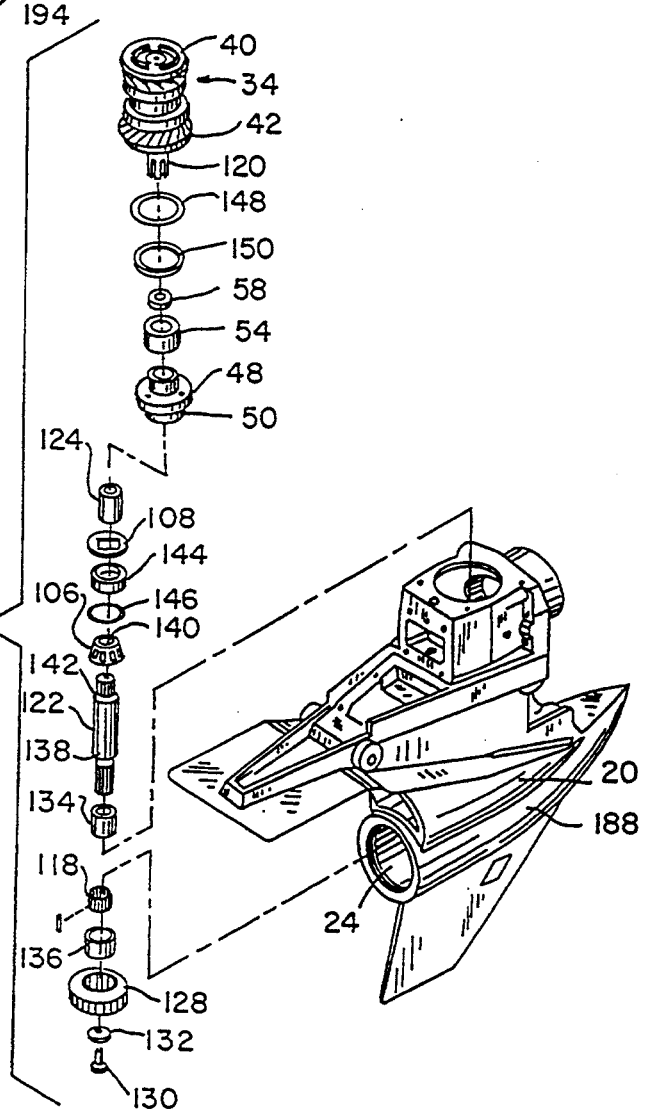
FIG. 4 is an exploded perspective view of a portion of the structure of FIG. 1.

Vertical bore 26 has a second thread, provided by the noted thread 46, above third section 100 and of an inner diameter 104 at least as great as third inner diameter 102. A central tapered roller thrust bearing 106 is seated against shoulder 94 of vertical bore 26. An annular ring 108 has a threaded outer portion 110 mating with thread 96 of vertical bore 26 and retains bearing 106 against shoulder 94. Vertical bore 26 has a fourth section 112 below first section 86 and of a fourth inner diameter 114 larger than first inner diameter 88. First and fourth sections 86 and 112 meet at a downwardly facing annular shoulder 116. A lower needle bearing 118 is seated against downwardly facing shoulder 116 and supports driveshaft 36 for rotation. Central and upper bearings 106 and 58 are inserted into vertical bore 26 from above, FIG. 4. Lower bearing 118 is inserted into vertical bore 26 from below.

Driveshaft 36, FIG. 3, is a two piece member formed by an upper driveshaft segment 120 and a lower driveshaft segment 122 coupled by a sleeve 124 in splined relation. Central bearing 106 and lower bearing 118 support the lower driveshaft segment 122. Upper bearing 58 supports the upper driveshaft segment 120. The upper driveshaft segment is also supported by another upper needle bearing 126, FIG. 2, as in the noted incorporated patents.

Driveshaft 36 has a lower pinion gear 128, FIG. 3, mounted thereto by bolt 130 and washer 132. Needle bearing 118 is above pinion gear 128 and is supported between inner and outer races 134 and 136. Outer race 136 engages shoulder 116, and inner race 134 engages shoulder 138 on lower driveshaft segment 122. Bearing 106 has an inner race 140 engaging shoulder 142 on lower driveshaft segment 122. Bearing 106 has an outer race 144 stopped against shoulder 94 in bore 26. One or more shims 146 may be provided between outer race 144 and shoulder 94 to adjust axial positioning if desired. Gear 42 rotates on bearing 148 on race 150 seated on shoulder 152 of housing sidewall 154.

Figure 2:
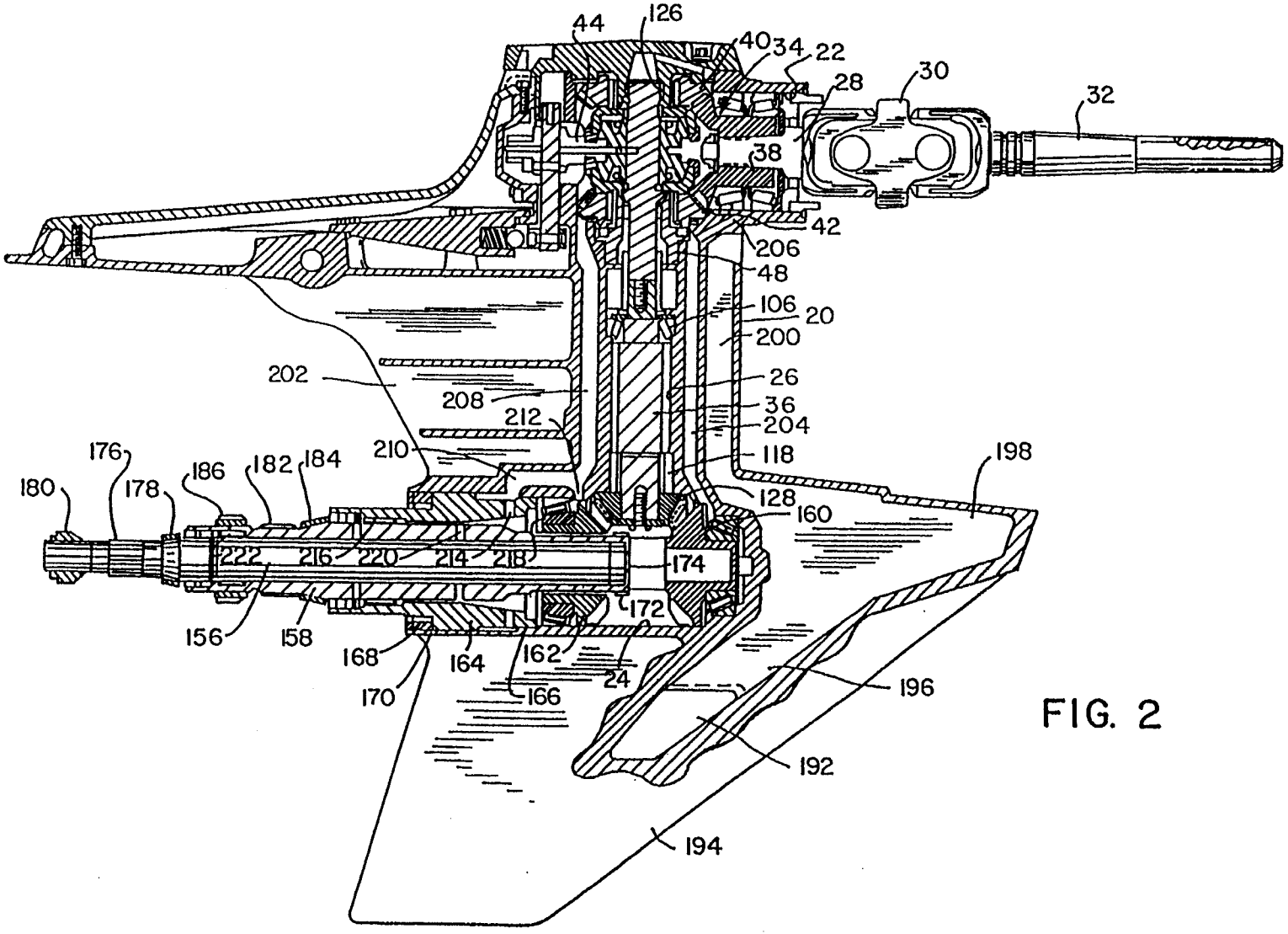
FIG. 2 is a partial sectional view of a portion of the structure of FIG. 1.

A pair of lower concentric counter-rotating inner and outer propeller shafts 156 and 158, FIG. 2, in lower horizontal bore 24 are driven by driveshaft 36. Inner propeller shaft 156 has a fore gear 160 driven by pinion gear 128 to drivingly rotate inner propeller shaft 156. Outer propeller shaft 158 has an aft gear 162 driven by pinion gear 128 to drivingly rotate outer propeller shaft 158 in the opposite rotational direction than inner propeller shaft 156. Reference is made to allowed incorporated U.S. application Ser. No. 07/889,530, filed May 27, 1992. The dual propeller shaft assembly is mounted in horizontal bore 24 by a spool assembly 164 at right hand threads 166 and retaining ring 168 having left hand threads 170. The right hand threads prevent right hand rotational loosening of the spool assembly, and the left hand threads 170 prevent left hand rotational loosening of the spool assembly. Forward thrust is transferred from the outer propeller shaft 158 to the inner propeller shaft 156 at thrust bearing 172 against annular shoulder 174 on inner propeller shaft 156. Propeller 12 is mounted on inner propeller shaft 156 in splined relation at 176 between tapered ring 178 and threaded nut 180. Propeller 14 is mounted on outer propeller shaft 158 in splined relation at 182 between tapered ring 184 and threaded nut 186.

The vertical distance between adaptor spool 48 and lower bearing 118 is about equal to the radius of propellers 12 and 14. Lower horizontal bore 24 of housing 20 is in the portion commonly called the torpedo 188, FIGS. 1 and 4. Torpedo 188 is slightly above the bottom 190 of boat 18 and hence is slightly above the surface of the water, thus reducing drag. This raising of the torpedo above the surface of the water is accomplished without a like raising of the engine in the boat nor the usual transom mounting location for the drive. In the preferred embodiment, the engine is raised 2 to 3 inches above its standard location. Housing 20 is a one-piece unitary integrally cast housing replacing prior two piece housings. Propeller shafts 156, 158 are spaced from upper input shaft 28 by a distance along driveshaft 36 in the range of about 8 to 15 inches.

Cooling water for the engine is supplied through water intake 192 in skeg 194, and flows through skeg passage 196 and then through torpedo nose passage 198 and then through housing passage 200 to the engine in the usual manner. After cooling the engine, the water and engine exhaust are exhausted in the usual manner through an exhaust elbow and exhausted through the housing and discharged at exhaust outlet 202 above torpedo 188 and into the path of the propellers in the upper portion of their rotation, as in U.S. Pat. 4,871,334. Oil is circulated from the lower gears upwardly through passage 204 and passage 206 to the upper gears, and returned to the lower gears at passage 208 feeding passages 210 and 212. Oil is supplied from passage 210 through spool assembly passage 214 to bearings 216 and 218, and through outer propeller shaft passage 220 to bearing 222. Passage 212 supplies oil to the front of bearing 218. Central outer section 64 of adaptor spool 48 closes off oil passage 204, to divert flow to passage 206.

Figures 5, 6:
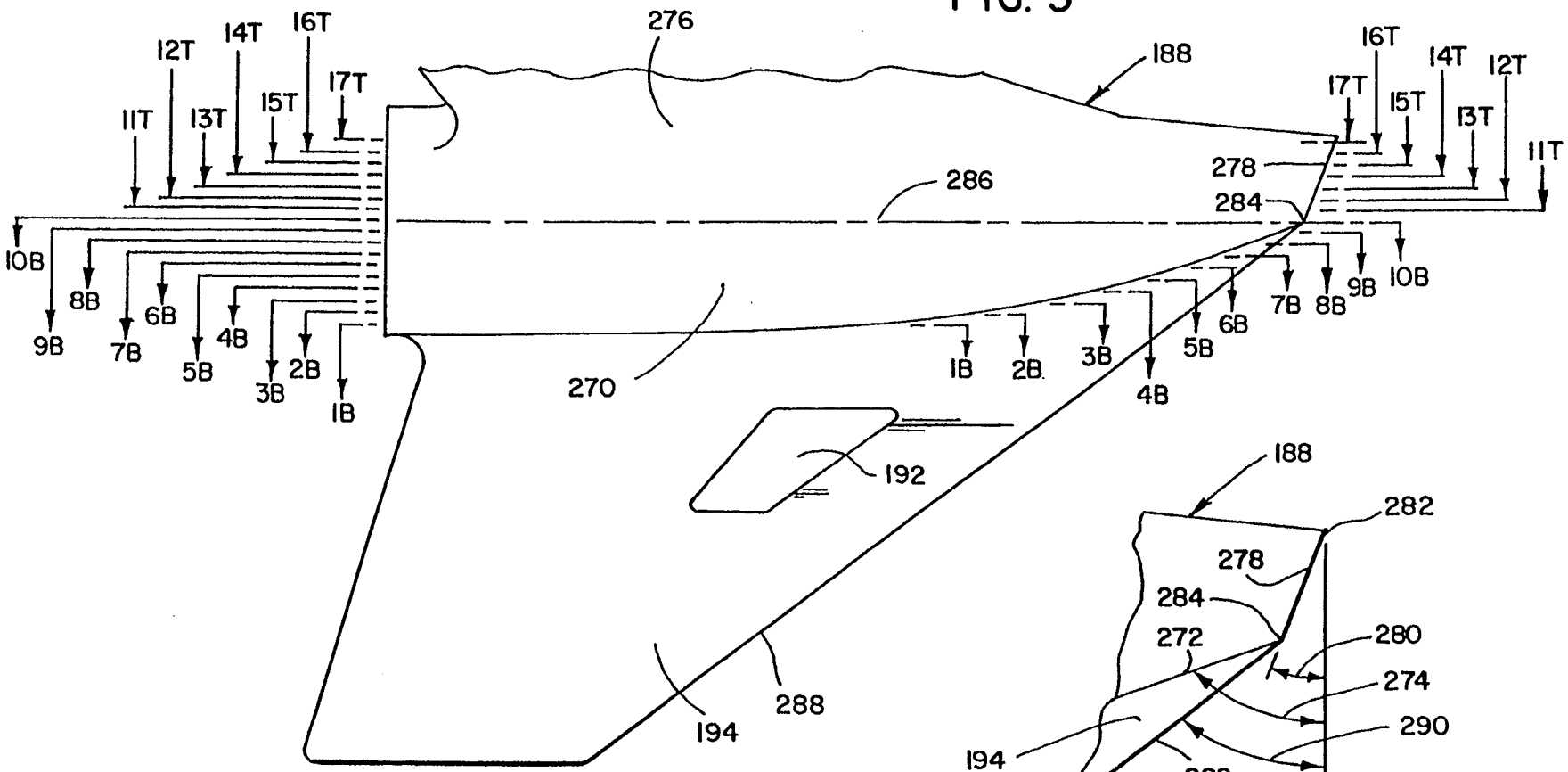
FIG. 5 is a side elevation view of a portion of the structure of FIG. 1.
FIG. 6 is an enlarged view of a portion of the structure of FIG. 5.
Figure 7:
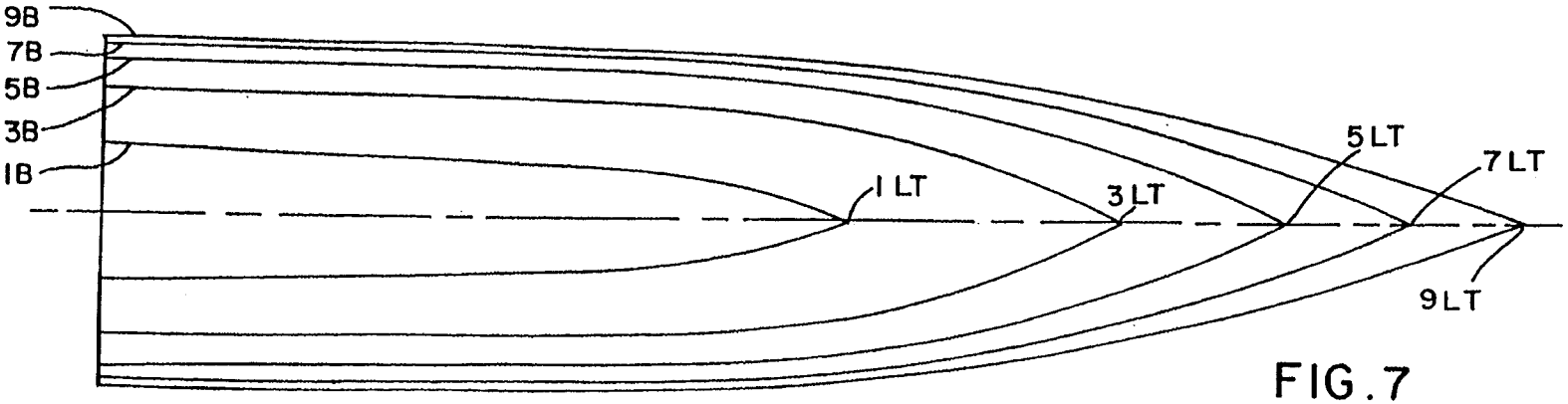
FIGS. 7–10 show outer surface profiles along horizontal cross-sections in FIG. 5.
Figure 8:
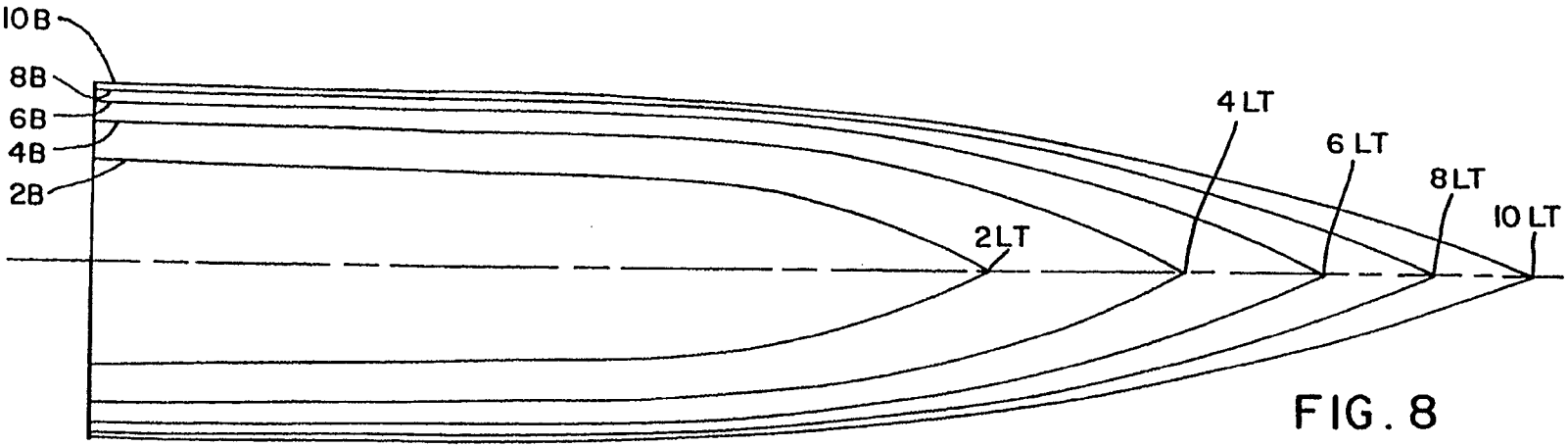
Figure 9:
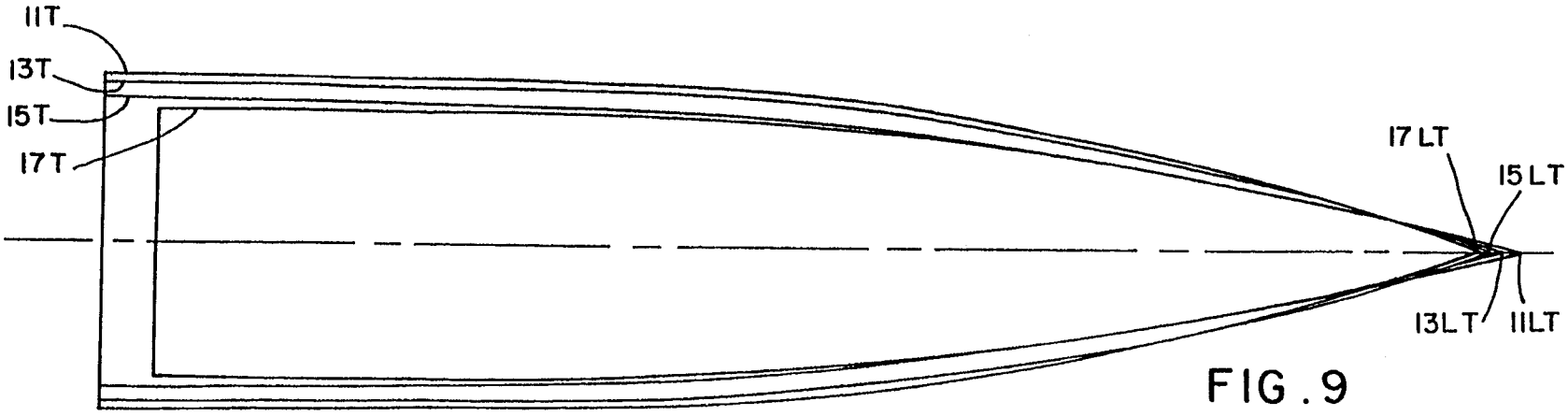
Figure 10:
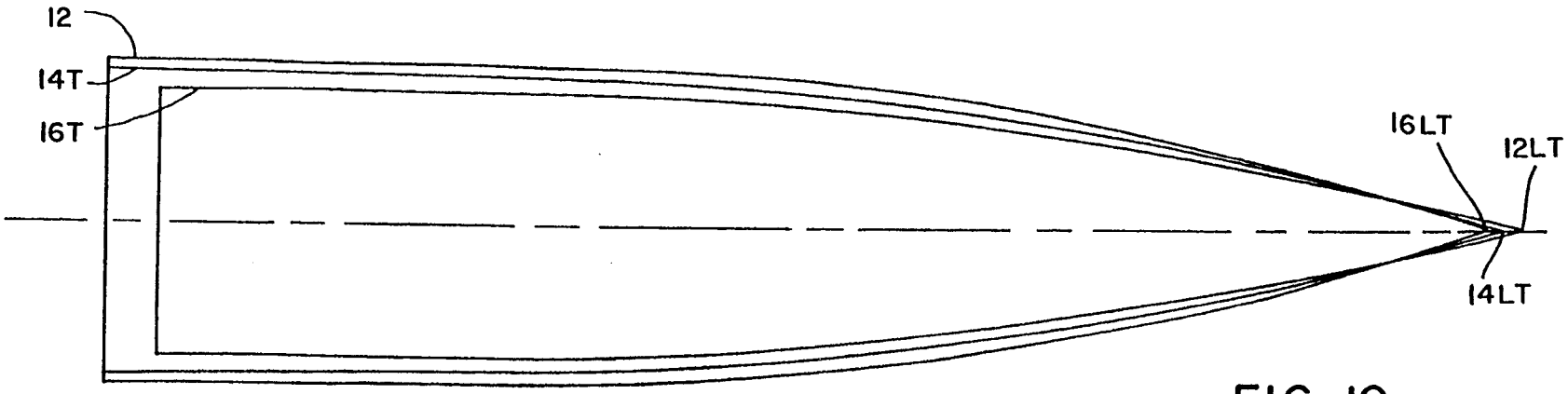

Lower horizontal torpedo portion 188 of housing 20 has a lower zone 270 with outer surface profiles as shown in FIGS. 7 and 8 at 1B, 2B, 3B, 4B, 5B, 6B, 7B, 8B, 9B, 10B, along horizontal cross-sections, FIG. 5, defining wedges with leading tips 1LT, 2LT, 3LT, 4LT, 5LT, 6LT, 7LT, 8LT, 9LT, 10LT, defining a line 272, FIG. 6, extending downwardly and rearwardly at an angle 274 relative to vertical. Lower horizontal torpedo portion 188 has an upper zone 276 with outer surface profiles as shown in FIGS. 9 and 10 at 11T, 12T, 13T, 14T, 15T, 16T, 17T, along horizontal cross-sections, FIG. 5, defining wedges with sharp leading tips 11LT, 12LT, 13LT, 14LT, 15LT, 16LT, 17LT, forming a sharp leading edge 278 for slicing through the water. The noted sharp leading tips are desirable where the boat builder wishes more flexibility in the vertical mounting position of the drive. If the boat builder wishes to mount the drive at a lower position, with the torpedo not entirely out of the water, then it is desired to provide a low drag surfacing torpedo with the noted sharp leading tips.

Sharp leading tips 11LT–17LT forming sharp leading edge 278 define a line at 278 extending downwardly and rearwardly at a given angle 280, FIG. 6, relative to vertical. During testing, it was found that angle 280 is preferably greater than about 15°, to prevent water creep-up along leading edge 278, to in turn reduce drag. In the preferred embodiment, angle 280 is about 21°, and angle 274 is about 70°. Sharp leading edge 278 extends from upper end 282 downwardly and rearwardly at the noted 21° angle to lower end 284. Line 272 extends downwardly and rearwardly from point 284 at the noted 70° angle relative to vertical. Lines 272 and 278 intersect at the horizontal cross-section along the horizontal center-line of horizontal bore 24 which center-line is coincident with the axis of rotation 286 of the concentric counter-rotating propeller shafts 156, 158. Point 284 lies on axis 286. Sharp leading edge 278 forms a straight rectilinear line. Line 272 is curved and extends downwardly and rearwardly from its intersection point 284 with line 278. The initial upper portion of line 272 forms the noted angle 274 relative to vertical, which angle increases as line 272 extends downwardly and rearwardly.

Housing 20 includes the noted skeg 194 extending downwardly from lower zone 270 of torpedo portion 188. Skeg 194 has a leading edge 288 defining a line extending downwardly and rearwardly at angle 290, FIG. 6, relative to vertical, which angle 290 is preferably about 53° . Leading edge 288 of the skeg extends forwardly and upwardly all the way to the lower end 284 of sharp leading edge 278. Angle 290 is greater than angle 280 and less than angle 274.

Outer surface profiles 1B–10B of torpedo lower zone 270 meet forwardly at skeg 194, and the skeg extends forwardly from such meeting of the lower zone outer surface profiles to leading edge 288. Leading edge 288 extends forwardly and upwardly and meets sharp leading edge 278 of upper zone 276 of the torpedo. The lines formed by leading edges 278 and 288 meet at the horizontal cross-section at 10B which is through the noted horizontal center-line of the lower horizontal bore 24, which center-line is coincident with the rotational axis 86 of the concentric counter-rotating propeller shafts 156, 158. Lines 278, 272, 288 all intersect at the same point 284 at axis 286.

It is recognized that various equivalents, alternatives and modifications are possible within the scope of the appended claims.

We claim:

1. A marine drive for propelling a boat comprising:

a housing having upper and lower spaced generally horizontal bores and an intersecting generally vertical bore extending therebetween;

an upper input shaft in said upper horizontal bore; a downwardly extending driveshaft in said vertical bore and driven by said input shaft;

a pair of lower concentric counter-rotating propeller shafts in said lower horizontal bore and driven by said driveshaft;

a pair of counter-rotating surface operating propellers each mounted to a respective one of said propeller shafts;

said housing comprising a lower generally horizontal torpedo portion around said lower horizontal bore, said torpedo portion having an upper zone with outer surface profiles along horizontal cross-sections defining wedges with sharp leading tips forming a sharp leading edge for slicing through the water, said sharp leading tips forming said sharp leading edge defining a first line extending downwardly and rearwardly at a first angle relative to a vertical line parallel to said driveshaft, said torpedo portion having a lower zone with outer surface profiles along horizontal cross-sections defining wedges with leading tips defining a second line extending downwardly and rearwardly at a second angle relative to said vertical line, said second angle being greater than said first angle.

2. The invention according to claim 1 wherein said first and second lines intersect at one of said horizontal cross-sections.

3. The invention according to claim 2 wherein said first line is a straight rectilinear line, and said second line is curved.

4. The invention according to claim 3 wherein said sharp leading edge extends along said straight rectilinear first line from an upper end to a lower end, and wherein said second line extends from said lower end of said sharp leading edge downwardly and rearwardly along said curved second line.

5. The invention according to claim 4 wherein said first and second lines intersect substantially at the rotational axis of said concentric counter-rotating propeller shafts.

6. A marine drive for propelling a boat comprising:

a housing having upper and lower spaced generally horizontal bores and an intersecting generally vertical bore extending therebetween;

an upper input shaft in said upper horizontal bore;

a downwardly extending driveshaft in said vertical bore and driven by said input shaft;

a pair of lower concentric counter-rotating propeller shafts in said lower horizontal bore and driven by said driveshaft;

a pair of counter-rotating surface operating propellers each mounted to a respective one of said propeller shafts;

said housing comprising a lower generally horizontal torpedo portion around said lower horizontal bore, said torpedo portion having an upper zone with outer surface profiles along horizontal cross-sections defining wedges with sharp leading tips forming a sharp leading edge for slicing through the water, said sharp leading tips forming said sharp leading edge defining a first line extending downwardly and rearwardly at a first angle relative to a vertical line parallel to said driveshaft, said torpedo portion having a lower zone with outer surface profiles along horizontal cross-sections defining wedges with leading tips defining a second line extending downwardly and rearwardly at a second angle relative to said vertical line, said second angle being greater than said first angle;

a skeg extending downwardly from said lower zone of said torpedo portion, said skeg having a leading edge defining a third line extending downwardly and rearwardly at a third angle relative to said vertical line, said third angle being greater than said first angle and less than said second angle.

7. The invention according to claim 6 wherein said lower zone outer surface profiles meet forwardly at said skeg.

8. The invention according to claim 7 wherein said skeg extends forwardly from said meeting of said lower zone outer surface profiles to said leading edge of said skeg.

9. The invention according to claim 8 wherein said leading edge of said skeg extends forwardly and upwardly and meets said sharp leading edge of said upper zone of said torpedo portion.

10. The invention according to claim 6 wherein said first and third lines intersect at one of said horizontal cross-sections.

11. The invention according to claim 10 wherein said first, second and third lines all intersect at the same point.

12. The invention according to claim 11 wherein said first, second and third lines intersect substantially at the rotational axis of said concentric counter-rotating propeller shafts.

* * * * *